US009228552B2

(12) United States Patent
Bernhaupt et al.

(10) Patent No.: US 9,228,552 B2
(45) Date of Patent: Jan. 5, 2016

(54) METHOD FOR TESTING AND REPAIRING A FUEL INJECTOR

(75) Inventors: Martin Bernhaupt, Oberalm (AT); Martin Jordan, Kirchberg (AT); Sabastian Rettenbacher, Adnet (AT); Gerhard Russegger, Golling (AT)

(73) Assignee: ROBERT BOSCH GMBH, Stuttgart-Feuerbach (DE)

( * ) Notice: Subject to any disclaimer, the term of this patent is extended or adjusted under 35 U.S.C. 154(b) by 293 days.

(21) Appl. No.: 13/825,612

(22) PCT Filed: Sep. 22, 2011

(86) PCT No.: PCT/AT2011/000390

§ 371 (c)(1),
(2), (4) Date: Mar. 22, 2013

(87) PCT Pub. No.: WO2012/037590

PCT Pub. Date: Mar. 29, 2012

(65) Prior Publication Data

US 2013/0185908 A1 Jul. 25, 2013

(30) Foreign Application Priority Data

Sep. 22, 2010 (AT) ..... A 1578/2010

(51) Int. Cl.

| | |
|---|---|
| ***F02M 59/48*** | (2006.01) |
| ***F02M 61/16*** | (2006.01) |
| ***F02M 65/00*** | (2006.01) |

(52) U.S. Cl.

CPC ..... *F02M 59/48* (2013.01); *F02M 61/168* (2013.01); *F02M 65/00* (2013.01); *F02M 65/001* (2013.01);

(Continued)

(58) Field of Classification Search

CPC ..... F02M 59/48; F02M 61/168; F02M 65/00; F02M 65/001; F02M 2200/8092; F02M 2200/40; Y10T 29/49718; Y10T 29/49721; Y10T 29/49764

See application file for complete search history.

(56) References Cited

U.S. PATENT DOCUMENTS

| | | | |
|---|---|---|---|
| 7,478,626 | B2 | 1/2009 | Schurz |
| 7,571,715 | B2 | 8/2009 | Frasch et al. |

(Continued)

FOREIGN PATENT DOCUMENTS

| | | | |
|---|---|---|---|
| CN | 101529081 | A | 9/2009 |
| DE | 10250720 | A1 | 5/2004 |

(Continued)

OTHER PUBLICATIONS

International Search Report dated Jan. 2, 2012, issued in International Application PCT/AT2011/000390.

*Primary Examiner* — John C Hong

(74) *Attorney, Agent, or Firm* — Fitch, Even, Tabin & Flannery, LLP

(57) ABSTRACT

In a method for testing and repairing an injector for injecting fuel into the combustion chamber of an internal combustion engine, wherein the injector includes a nozzle, a restrictor plate, and a control valve, and a nozzle clamping nut which holds together said parts and by way of which said parts are fastened to an injector body of the injector. The functional components—nozzle, restrictor plate and control valve—are separated from the injector body. A connection piece serves to connect the functional components to a test bench is screwed to the functional components with the aid of the nozzle clamping nut to form an injector module. The injector module is connected to a test bench and subjected to testing, and afterwards optionally repairing.

6 Claims, 2 Drawing Sheets

(52) U.S. Cl.
CPC .... *F02M 2200/40* (2013.01); *F02M 2200/8092* (2013.01); *Y10T 29/49718* (2015.01); *Y10T 29/49721* (2015.01); *Y10T 29/49764* (2015.01)

(56) References Cited

U.S. PATENT DOCUMENTS

| | | | | |
|---|---|---|---|---|
| 8,113,176 | B2 | 2/2012 | Rossignol et al. | |
| 2003/0111220 | A1 | 6/2003 | Bell | |
| 2006/0151637 | A1 | 7/2006 | Schneider et al. | |
| 2008/0011885 | A1 | 1/2008 | Schurz | |
| 2008/0121215 | A1 | 5/2008 | Frasch et al. | |
| 2008/0134488 | A1 * | 6/2008 | Anzinger et al. | 29/428 |
| 2009/0324767 | A1 * | 12/2009 | Kloeppel et al. | 425/190 |
| 2010/0071665 | A1 | 3/2010 | Rossignol et al. | |

FOREIGN PATENT DOCUMENTS

| | | | |
|---|---|---|---|
| DE | 10 2005 004 327 | A1 | 8/2006 |
| DE | 102005020833 | A1 | 11/2006 |
| FR | 2 917 137 | A1 | 12/2008 |
| JP | 60-060267 | A | 4/1985 |
| WO | 2005/108772 | A1 | 11/2005 |
| WO | WO2008/040588 | * | 4/2008 |

* cited by examiner

METHOD FOR TESTING AND REPAIRING A FUEL INJECTOR

CROSS-REFERENCE TO RELATED APPLICATIONS

This application is a U.S. National Stage Application filed under 35 U.S.C. §371 of International Application PCT/AT2011/000390, filed Sep. 22, 2011, designating the United States, which claims priority from Austrian Patent Application A 1578/2010, filed Sep. 22, 2010, the complete disclosures of which are hereby incorporated herein by reference in their entirety for all purposes.

BACKGROUND INFORMATION

The invention relates to a method for testing and repairing an injector for injecting fuel into the combustion chamber of an internal combustion engine, wherein the injector includes a nozzle, a restrictor plate, and a control valve, and a nozzle clamping nut which holds together said parts and by way of which said parts are fastened to an injector body of the injector.

In servo-controlled injectors for internal combustion engines and, in particular, in modular common-rail injection systems, injection control is performed by the aid of an electronically actuated control or servo valve. The control valve controls the discharge of fuel from the control chamber of an injection nozzle, which realizes the hydraulic operation of an injection nozzle. By modular common-rail injection systems, injections systems are understood, which are above all used in particularly large engines, in which the individual injectors are sometimes fixed at considerable mutual distances such that the single use of a common rail for the injectors does not make sense. In such engines, it is therefore provided to assign each injector a separate high-pressure fuel storage device integrated in the injector. Such a mode of construction is referred to as a modular structure, since each individual injector has its own high-pressure fuel storage device and can thus be used as an independent injector unit. A high-pressure fuel storage device in this context does not imply just an ordinary line, but a high-pressure fuel storage device is meant to be a pressure-proof vessel having a supply line and a discharge line and whose diameter is considerably enlarged compared to high-pressure lines, in order to enable a certain injection amount to be discharged from the high-pressure fuel storage device without causing an immediate pressure drop, as would happen if the injection amount were taken from an ordinary high-pressure line.

Modular injectors, to which the present invention refers, in addition to the high-pressure fuel storage device integrated in the injector body include a functional group comprising a nozzle, a restrictor plate and a control valve as functional components, which are screwed to the injector body by a nozzle clamping nut. The injection characteristics of an injector in this case are exclusively influenced by the tolerance positions of the above-described functional components. In order to ensure that the injection amounts of the individual injectors fall within a very narrow tolerance band, it will frequently not suffice to produce the nozzle, the restrictor plate and the servo valve within narrow tolerances. In many cases, these three functional components are selectively paired based on specific characteristic features, or individual properties are selectively produced or adjusted only after having measured the other functional components in respect to their functionally critical characteristic features. The correct combination of nozzle, restrictor plate and servo or control valve will thus be decisive for an injector to operate within a very narrow tolerance band.

For the first delivery, the injectors are completely, screwed together and functionally tested on elaborately calibrated test benches during the initial assembly. Injectors that lie outside the set tolerance limits will again be disassembled, one or several functional components will be exchanged, and the injectors will again be screwed together and checked anew. After a defined engine operating time, it is, furthermore, provided to periodically clean and disassemble the injectors, renew the functional components as required, and subsequently mount, and functionally test, the complete injectors as in the case of the first delivery. In the hitherto known test and repair methods, both cases, on the location of manufacture of the injectors, each have involved the handling of partially very heavy injector bodies occasionally weighing 10 kg and more, in addition to the relatively light-weight and small functional components. In the case of repair, the whole injectors with the high-pressure fuel storage devices have to be collected and transported to a central location where they can be repaired.

SUMMARY

The invention is, therefore, based on the object to further develop a method of the initially-defined kind to the effect that handling with the heavy and bulky storage devices can be avoided for the adjustment and repair of the functional components determining the injection characteristics of the respective injector.

To solve this object, the method according to the invention is, therefore, characterized in that the functional components—nozzle, restrictor plate and servo valve—are separated from the injector body, a connection piece that serves to connect the functional components to a test bench is screwed to the functional components with the aid of the nozzle clamping nut to form an injector module, and the injector module is connected to a test bench and subjected to testing, and afterwards optionally repairing. In that the injector body can be separated from the functional components, the injector body can remain on the internal combustion engine while the functional components are subjected to inspection and, if required, maintenance independently of the former, wherein even preset, new functional components of a second injector module can be fitted to an injector body of an internal combustion engine with minimal efforts such that the internal combustion engine will again be ready for operation requiring only little mounting expenditures. A preferred mode of operation provides that the injector module is disassembled into its individual parts—connection piece, servo valve, restrictor plate, nozzle, nozzle clamping nut—and the new functional components—nozzle, restrictor plate, servo valve—are screwed to the injector body remaining on the internal combustion engine by the new nozzle clamping nut to form a new injector. The rest of the connection piece is preferably screwed with the dismounted functional components and the old nozzle clamping nut, returned to the manufacturing installation, and connected to a test bench that simulates the connection situation in an internal combustion engine. After testing and repairing, the injector module is again transported back to the internal combustion engine, where it can be used to substitute for the functional components of a further injector. In this manner, repairing will be considerably facilitated, since only the small functional components need to be taken to the manufacturing installation, thus significantly reducing the efforts involved in transportation and the transport costs.

DETAILED DESCRIPTION

Figure 1:
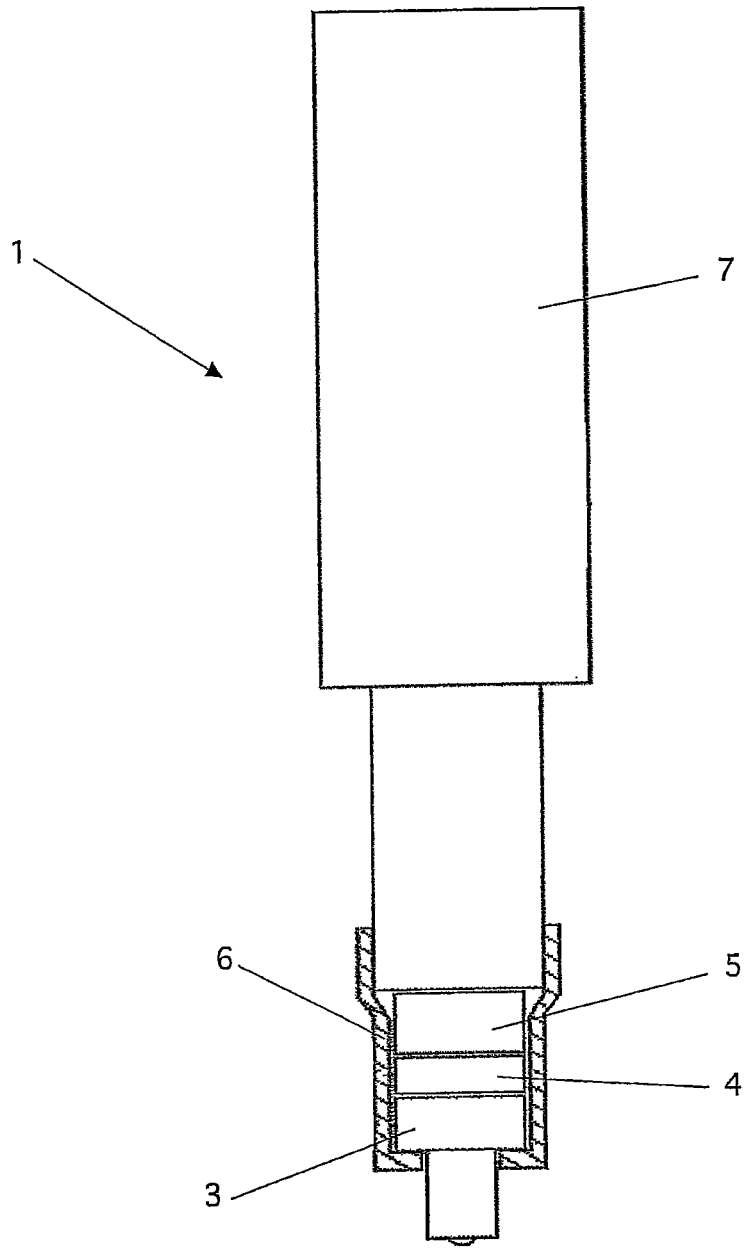
FIG. 1 illustrates an injector having functional components fixed to an injection body.

A method for testing and repairing an injector for injecting fuel into the combustion chamber of an internal combustion engine, wherein the injector includes a nozzle, a restrictor plate, and a control valve, and a nozzle clamping nut which holds together said parts and by way of which said parts are fastened to an injector body of the injector, characterized in that the functional components—nozzle (3), restrictor plate (4) and control valve (5)—are separated from the injector body (7), a connection piece (8) that serves to connect the functional components (3,4,5) to a test bench is screwed to the functional components (3,4,5) with the aid of the nozzle clamping nut (6) to form an injector module (2), and the injector module (2) is connected to a test bench and subjected to testing, and afterwards optionally repairing.

In another aspect of the method, the screwing of the connection piece (8) to the functional components (3,4,5) to form said injector module (2) is performed on site, e.g. on the location of the internal combustion engine, the injector module (2) is subsequently transported to a test bench remote from the location of the internal combustion engine and the functional components (3,4,5) are tested, and the repair of the functional components (3,4,5) is performed in a manufacturing installation remote from the location of the internal combustion engine without the injector body (7) likewise being transported to the manufacturing installation.

In another aspect of a method, the connection piece (8) is screwed to the nozzle clamping nut (6) in such a manner that the nozzle (3), the restrictor plate (4) and the control valve (5) are secured in the nozzle clamping nut (6).

In a still further aspect of the method, the connection piece (8) is screwed to the nozzle clamping nut (6) in such a manner that the nozzle (3), the restrictor plate (4) and the control valve (5) are secured in the nozzle clamping nut (6).

According to a preferred embodiment, the method according to the invention is further developed to the effect that the screwing of the connection piece to the functional components so as to form said injector module is performed on the location of the internal combustion engine, that the injector module is subsequently transported to a test bench remote from the location of the internal combustion engine and the functional components are tested, and that the repair of the functional components is performed in a manufacturing installation remote from the location of the internal combustion engine without the injector body likewise being transported to the manufacturing installation. In principle, the connection piece serves both to enable a test of the functional components in the thus formed injector module to be performed on a test bench independently of the injector body, and to function as a transport securing device for the functional components comprised by the injector module.

In the mounting situation on the internal combustion engine, the functional components—nozzle, restrictor plate and servo valve—are fixed to the injector body by the nozzle clamping nut. After dismounting, there is thus the risk that parts will get loose or be lost for the repair work during transportation. The method according to the invention is, therefore, preferably further developed to the effect that the connection piece is inserted into the nozzle clamping nut in such a manner that the nozzle, the restrictor plate and the control valve are secured in the nozzle clamping nut.

In the following, the invention will be explained in more detail by way of an exemplary embodiment schematically illustrated in the drawing.

In FIG. 1, an injector according to the invention is denoted by 1, in which the functional components of the injector are disposed, comprising a nozzle 3, a restrictor plate 4 and a control valve 5, wherein the functional components are fixed to the injector body 7 including a storage volume by the aid of a nozzle clamping nut 6.

Figure 2:
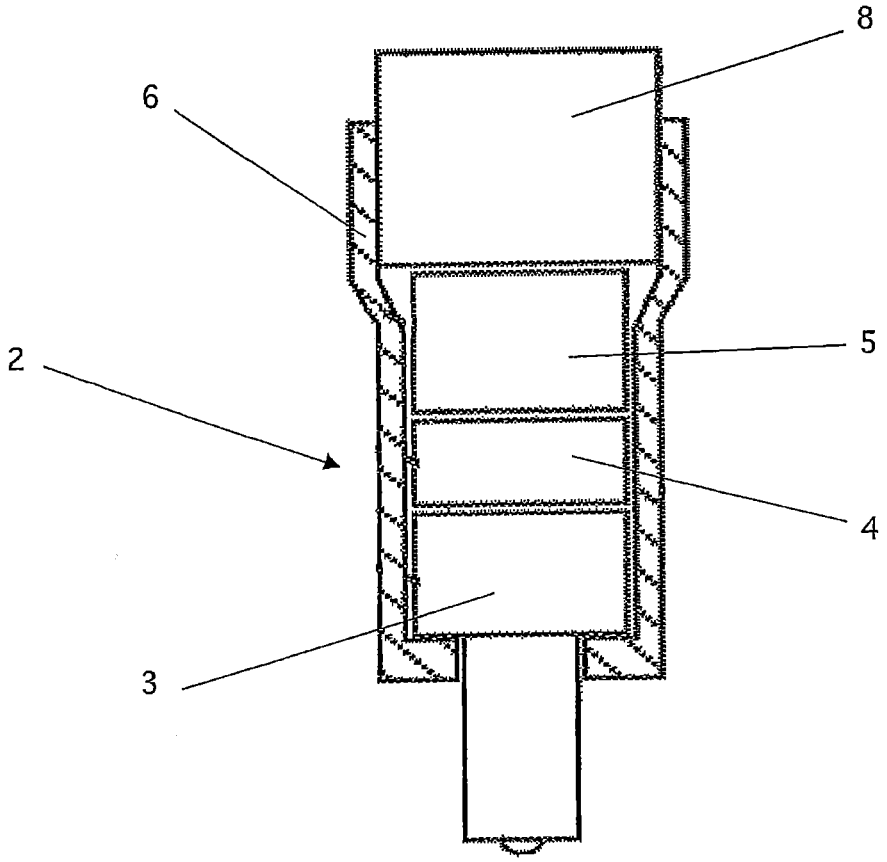
FIG. 2 illustrates an enlargement of a portion of FIG. 1.

To carry out the method according to the invention, the screw connection between the injector body 7 and the nozzle clamping nut 6 is released, and the functional components 3, 4, 5 are removed. After this, the functional components 3, 4, 5 are connected to a connection piece 8 by the nozzle clamping nut 6 to form the injector module 2 depicted in FIG. 2, which, on the one hand, will secure the functional components 3, 4, 5 in the nozzle clamping nut 6 during transportation to testing and repair and, on the other hand, will be connectable to the test bench for testing the functional components 3, 4, 5 in the injector module 2.

The invention claimed is:

1. A method for testing an injector for injecting fuel into a combustion chamber of an internal combustion engine, said injector having an injector body, said injector including functional components comprising a nozzle, a restrictor plate, and a control valve, and having a nozzle clamping nut to hold said functional components together and to fasten said functional components to said injector body, said method comprising:

(a) separating said functional components from said injector body;

(b) providing a connection piece, and (c) connecting said connection piece to connect together said functional components with said clamping nut to thereby form an injector module;

(d) connecting said injector module to a test bench; and (e) subjecting said injector module to testing.

2. The method according to claim 1, wherein said method further comprises (f) repairing said injector.

3. The method according to claim 2, wherein the connection piece is screwed to the nozzle clamping nut in such a manner that the nozzle, the restrictor plate and the control valve are secured in the nozzle clamping nut.

4. The method according to claim 1, wherein in (c), said clamping nut has a first end and a second end portion, and said connection piece has a portion for fitting within and engaging the first end portion of said clamping nut.

5. The method according to claim 1, wherein in (c), said connection piece is screwed to said nozzle clamping nut such that said functional components are secured in said nozzle clamping nut.

6. The method according to claim 1, wherein in (c) is conducted while on location at the internal combustion engine, and said method further comprises thereafter, but before (d), transporting the injector module to a test bench.

* * * * *